United States Patent [19]

Luca, Jr.

[11] 4,281,887

[45] Aug. 4, 1981

[54] ELECTRICAL CONNECTOR

[75] Inventor: Vincent A. Luca, Jr., Sidney, N.Y.

[73] Assignee: The Bendix Corporation, Southfield, Mich.

[21] Appl. No.: 16,708

[22] Filed: Feb. 28, 1979

[51] Int. Cl.[3] ..... H01R 13/58

[52] U.S. Cl. ..... 339/103 M; 29/854

[58] Field of Search ..... 339/103 M, 59 M, 63 M, 339/105, 192 R, 206 R, 207 R, 210 M, 217 R; 29/854–859

[56] References Cited

U.S. PATENT DOCUMENTS

| | | | |
|---|---|---|---|
| 2,896,186 | 7/1959 | Hardmark | 339/103 M |
| 2,963,536 | 12/1960 | Kokalas | 339/103 M X |
| 3,165,369 | 1/1965 | Maston | 339/59 M |
| 3,182,278 | 5/1965 | Bridle | 339/59 M |
| 3,402,382 | 9/1968 | DeTar | 339/192 R X |

*Primary Examiner*—Neil Abrams

*Attorney, Agent, or Firm*—Raymond J. Eifler; Charles D. Lacina

[57] ABSTRACT

An electrical connector assembly having a strain relief grommet (30) spaced apart from a moisture sealing grommet (20) to prevent radial forces applied to a wire (40) entering the moisture sealing grommet from deflecting a passage (22) in the moisture sealing grommet and allowing moisture to enter the passage (22).

16 Claims, 8 Drawing Figures

FIG. 5
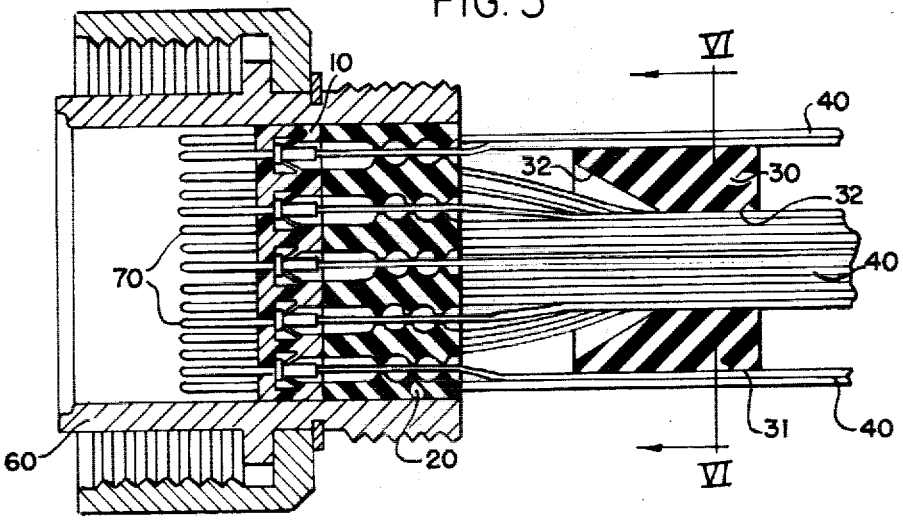
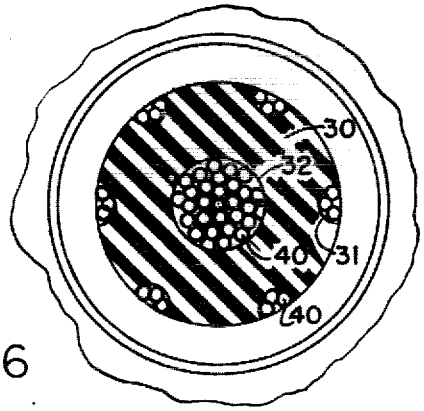
FIG. 6
FIG. 8
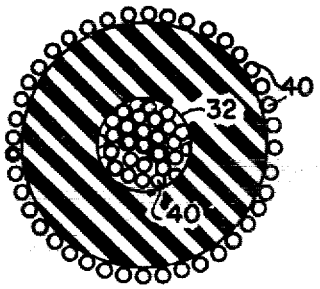
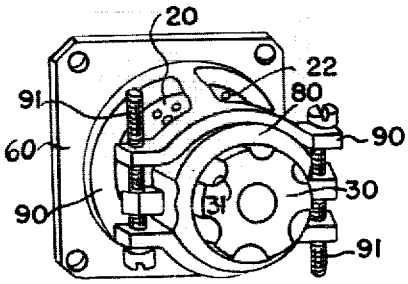
FIG. 7

ELECTRICAL CONNECTOR

BACKGROUND OF THE INVENTION

This invention relates to electrical connectors of the type having insertable and removable electrical contacts. The invention is more particularly related to a strain relief grommet located adjacent a moisture sealing grommet.

Electrical connectors generally include a plug and receptacle, each of which has an insert of dielectric material provided with multiple opening within which electrical contacts are retained. The insert is introduced from the rearward end of the metallic shell where it is held in place by an adhesive bond. Some connectors provide for rear insertion and release of electrical contacts while other connectors provide for front insertion and release of electrical contacts. These features are desirable and facilitate the assembly and servicing of a connector. Examples of prior art electrical connectors having insertable and removable contacts may be found in U.S. Pat. No. 3,165,369 entitled "Retention System For Electrical Contacts" issued Jan. 12, 1966; and U.S. Pat. No. 3,221,292 entitled "Electrical Connector" issued June 30, 1965.

In many of these types of connectors it is desirable to provide a moisture sealing grommet adjacent the contact retaining insert at the receiving end of the connector to seal out moisture which would otherwise enter the connector along the wires attached to the contacts. An example of such a moisture sealing grommet may be found in U.S. Pat. No. 4,082,398 entitled "Electrical Connector With Front and Rear Insertable and Removable Contacts" issued Apr. 4, 1978; and U.S. Pat. No. 3,402,382 entitled "Multicontact Connector With Removable Contact Members" issued Sept. 17, 1968. To prevent the wires from being separated from the contacts, when an axial force is applied to the cable containing wires, many of these types of connector employ strain relief devices. One example of a typical strain relief that can be utilized with these types of electrical connectors may be found in U.S. Pat. No. 3,792,417 entitled "Strain Relief Clamp For an Electrical Connector", issued Feb. 12, 1974.

Even with a moisture sealing grommet moisture enters some of the connectors causing electrical failure. One type of connector that was failing was one where the wires coming from the connectors were bent at an angle with respect to the connector. Accordingly, this bending of the wires immediately upon exiting a connector causes displacement of the wire receiving bores in the moisture sealing grommet allowing moisture to enter the connector.

SUMMARY OF THE INVENTION

To eliminate the problem associated with moisture entering electrical connectors because of the bending of wires as they leave a connector, a second grommet (30) having a recessed end portion (33), a plurality of grooves (31) and a central passage (32) all adapted to receive wires (40) entering the connector, mounted adjacent a moisture sealing grommet (20).

One advantage of the invention is that when the wires leaving the connector housing are pulled at an angle to the housing, the bores in the moisture sealing grommet are not displaced.

Another advantage of the invention is that connectors already manufactured are easily modified by simply adding a strain relief device to the connector that includes this second grommet.

This invention is an electrical connector assembly characterized by a second grommet (30) having a recessed end portion (33) for guiding wires (40) into a central passage (32) in the second grommet and allows wires to pass around the outside of the second grommet.

Accordingly, it is an object of this invention to provide a second grommet for an electrical connector which will improve the moisture resistance characteristics of the electrical connector.

It is another object of this invention to provide a compact electrical connector assembly that includes a strain relief grommet.

The above and other objects and features of the invention will become apparent from the following detailed description taken in conjunction with the accompanying drawings and claims which form a part of this specification. Further, the use of numerals is for the purpose of clarification only and is not intended to limit the specific structure illustrated.

BRIEF DESCRIPTION OF THE DRAWINGS

FIG. 5 illustrates an electrical connector assembly utilizing the features of this invention.

FIG. 6 is a cross-sectional view of the connector assembly shown in FIG. 5.

FIG. 7 illustrates how the strain relief grommet is connected to an electrical connector housing.

FIG. 8 is another view of another embodiment of the second grommet incorporating features of this invention.

DETAILED DESCRIPTION OF THE DRAWINGS

Figure 1:
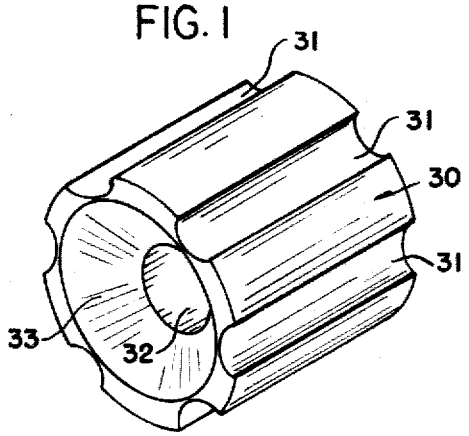
FIGS. 1, 2 and 3 illustrate a strain relief grommet incorporating the principles of this invention.

FIG. 1 illustrates a view of a strain relief grommet 30 that incorporates the principles of this invention. The strain relief grommet 30 includes a plurality of serrations or grooves 31 around the outer periphery of the grommet, a central passage 32, and a recessed or radially inwardly extending portion 33 at one end of the grommet. Preferably, the grommet is comprised of a silicon rubber material.

Figure 2:
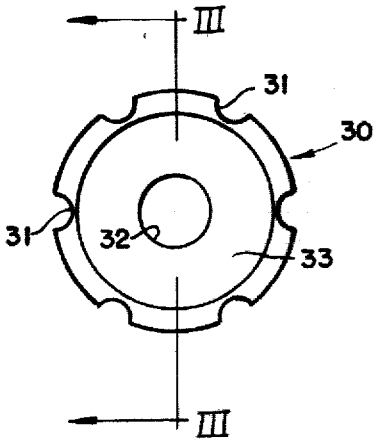

FIG. 2 illustrates an end view of the strain relief grommet 30 and the arrangement of the passage 32 along the central axis of the grommet.

Figure 3:
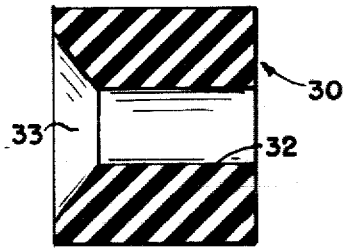

FIG. 3 is a cross-sectional view of the strain relief grommet 30 taken along lines III—III of FIG. 2. This cross-sectional view illustrates the wire receiving recessed portion 33 at one end of the strain relief grommet 30.

Figure 4:
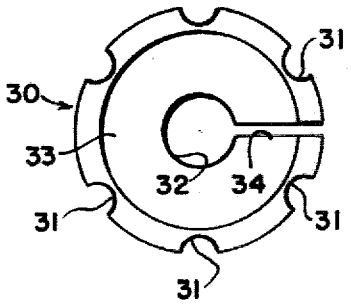
FIG. 4 illustrates an alternate embodiment of the invention.

FIG. 4 is an alternate embodiment of the strain relief grommet 30 and includes a slot 34 which extends the entire length of the grommet. It is the function of the slot 34 to allow wires to be moved into the central passage 32 from the side of the grommet.

FIG. 5 illustrates the strain relief grommet 30 in combination with the electrical connector assembly. Generally, the electrical connector assembly includes a connector housing 60, a plurality of electrical contacts 70, a plastic or dielectric insert 10 for mounting the contacts in the connector housing 60, a moisture sealing grommet 20, and wires 40 extending through the moisture sealing grommet 20 and connected to the respective contacts. This Figure illustrates how the wires 40 connected to the contacts either pass along the grooves 31 or through the central passage 32 in the strain relief grommet 30. It also illustrates how the recessed portion 33 permits most of the wires 40 to be directed into the central passage 32 thereby allowing the second grommet to be located close to the moisture sealing grommet thereby saving space and making the electrical connector assembly compact. The second grommet 30 is preferably spaced a short distance from the first grommet 20. The wires connected to the contacts in the outside portion of the connector go through the slots 31 while the wires connected to the inside contacts go through the central passage 32. It is this arrangement that prevents radial forces applied to the wires 40 exiting from the strain relief grommet 30 from being transmitted to the passages 22 in the moisture sealing grommet thereby preventing distortion of the passages 22 in the moisture sealing grommet which would otherwise result in moisture entering the electrical connector assembly.

FIG. 6 is a cross-sectional view of the electrical connector assembly shown in FIG. 5 taken along lines VI—VI. This Figure illustrates how all the wires 40 exiting from the moisture sealing grommet are arranged to pass either through the central passage 32 or the grooves 31 and the strain relief grommet 30.

FIG. 7 is a pictorial view of a portion of an electrical connector assembly having mounted thereon the strain relief grommet 30 but without any incoming wires. In this embodiment the strain relief grommet 30 is mounted to the connector assembly housing 60 by a coupling nut 90. As an additional feature of the invention there is an annular ring 80 comprised of a resilient material such as silicon rubber which surrounds the strain relief grommet 30. It is the function of the resilient annular member 80 to prevent compressive forces from being asserted on wires in the grooves 31 when the screws 91 threaded into the coupling nut 90 are tightened. This Figure illustrates how wires (not shown) leaving the passages 22 and the moisture sealing grommet 20 would then travel along the grooves 31 or through the central passage 32 of the strain relief grommet.

FIG. 8 illustrates another embodiment of the invention which eliminates the axially extending grooves. In this embodiment the strain relief grommet 30 includes a recessed portion 33 at one end thereof and a central passage 32 that extends from the recessed portion to the other end. In this embodiment wires would pass through the central passage 32 and any remaining wires, not passing through the central passage, would pass along the peripheral surface of the grommet. Wires passing along the peripheral surface of the grommet would be maintained in place by an annular ring which would compressively maintain the wires in position. This embodiment may also include a wire receiving slot (not shown) that would extend the entire length of the central passage to the peripheral surface of the grommet to allow wires to be pressed into the central passage 32.

While a preferred embodiment of the invention has been disclosed it will be apparent to those skilled in the art that changes may be made to the invention as set forth in the appended claims, and, in some instances, certain features of the invention may be used to advantage without corresponding use of other features. Accordingly, it is intended that the illustrative and descriptive materials herein be used to illustrate the principles of the invention and not to limit the scope thereof.

Having described the invention what is claimed is:

1. In combination with an electrical connector of the type having a housing, a plurality of electrical contacts, means for mounting said contact within a said housing, and a moisture sealing grommet comprised of a resilient material having a plurality of longitudinal bores adapted to receives wires terminating at respective contacts, said grommet located adjacent said contact mounting means, the improvement comprising:

a second grommet spaced apart from the moisture sealing grommet and the contact mounting means and having a plurality of grooves for receiving some of said wires arranged about the outer periphery and a central passage having a diameter large enough for passing other of said wires extending from a first surface to a second surface, one of said surfaces extending radially inwardly to said central passage, said wires passing through said central passage and said grooves for connection to different ones of said electrical contacts; and means for mounting said second grommet adjacent said moisture sealing grommet, said second grommet preventing radial forces applied to the wires from being transmitted to the moisture sealing grommet.

2. The combination recited in claim 1 wherein said grooves in said second grommet are sufficiently recessed to accommodate the plurality of wires adapted to be connected to respective contacts.

3. The combination recited in claim 1 wherein said second grommet includes a wire receiving slot extending from said central passage to the periphery of said grommet.

4. The combination recited in claim 2 wherein said second grommet is comprised of a resilient material.

5. The combination recited in claim 2 wherein said means for mounting said second grommet includes:

a coupling nut;

means for mounting said coupling to one end of said connector housing; and means for mounting said second grommet to said coupling nut whereby when said coupling nut is mounted to said connector housing, said second grommet is adjacent said moisture sealing grommet.

6. The combination as recited in claim 5 wherein said means for mounting said second grommet to said coupling nut further includes:

an annular ring mounted around the periphery of said second grommet.

7. The combination as recited in claim 6 wherein the annular ring is comprised of a resilient material.

8. The combination recited in claim 3 wherein said means for mounting said second grommet includes:

a coupling nut;

means for mounting said coupling to one end of said connector housing; and means for mounting said second grommet to said coupling nut whereby when said coupling nut is mounted to said connector housing, said second grommet is adjacent said moisture sealing grommet.

9. The combination as recited in claim 8 wherein said means for mounting said second grommet in said coupling nut further includes:

an annular ring mounted around the periphery of said second grommet.

10. The combination as recited in claim 9 wherein the annular ring is comprised of a resilient material.

11. In combination with an electrical connector of the type having a housing, a plurality of electrical contacts, means for mounting said contacts with said housing, and a moisture sealing grommet comprised of a resilient material having a plurality of logitudinal bores adapted to receive wires terminating at respective contacts, said grommet located adjacent said contact mounting means, the improvement comprising:

a second grommet having a central passage extending from a first surface to a second surface and a wire receiving slot extending from said central passage to the periphery of said grommet, one of said surfaces extending radially inwardly to said central passage, a plurality of said wires passing through said central passage for connection to different ones of said electrical contacts; and means for mounting said second grommet spaced apart from said moisture sealing grommet with said inwardly extending portion of said second grommet facing said first grommet, said second grommet preventing radial forces applied to the wires from being transmitted to the moisture sealing grommet.

12. The combination recited in claim 11 wherein said grommet is comprised of a resilient material.

13. The combination as recited in claim 11 wherein said means for mounting said second grommet said coupling nut further includes: an annular ring mounted around and spaced from the periphery of said second grommet.

14. The combination as recited in claim 13 wherein the annular ring is comprised of a resilient material.

15. The combination recited in claim 13 wherein said second grommet includes a wire receiving slot extending from said central passage to the periphery of said grommet.

16. A method of preventing moisture from entering an electrical connector of the type having a shell, a contact retainer, a moisture sealing grommet adjacent the retainer, said grommet and retainer being assembled within the shell and a plurality of electrical contacts disposed in the retainer and electrically terminated to the end of a wire, the wires extending outwardly from and aftwardly of the moisture sealing grommet, the method comprising the steps of:

providing a strain relief grommet, the strain relief grommet of the type including first and second surfaces, an outer periphery, a plurality of wire receiving grooves for receiving some of said wires arranged about the outer periphery and a central passage for receiving other of said wires extending between the end surfaces, one of said end surfaces extending radially inwardly to said central passage, said wires passing through said central passage and across said grooves for connection to different ones of said electrical contacts;

providing means for mounting the strain relief grommet aftwardly of the moisture sealing grommet wherein said one end surface faces the wires extending outwardly from the moisture sealing grommet;

positioning the strain relief grommet adjacent to and in spaced apart relation to the moisture sealing grommet;

directing the wires from the contacts and the contact retainer through the central passage and/or along the grooves of the strain relief grommet; and assembling the strain relief grommet with the mounting means, said strain relief grommet preventing radial forces applied to the wires from being transmitted to the moisture sealing grommet.

* * * * *